US005138964A

United States Patent [19]

Watson

[11] Patent Number: 5,138,964

[45] Date of Patent: Aug. 18, 1992

[54] OIL SPILL CONTROL FOR AN OIL TANKER AND METHOD OF USING SAME

[75] Inventor: Ronald P. Watson, Altoona, Iowa

[73] Assignees: William Langford; John S. Ford, both of Des Moines, Iowa ; part interest to each

[21] Appl. No.: 709,114

[22] Filed: Jun. 3, 1991

[51] Int. Cl.[5] ..... B63B 43/16

[52] U.S. Cl. ..... 114/229; 210/779

[58] Field of Search ..... 114/227-229, 114/270; 414/137.3, 137.8; 210/776, 923; 405/63, 66, 68, 191

[56] References Cited

U.S. PATENT DOCUMENTS

| | | | |
|---|---|---|---|
| 635,939 | 10/1899 | Mason | 114/229 |
| 689,979 | 12/1901 | Mason | 114/229 |
| 1,307,040 | 6/1919 | Christensen | 114/229 |
| 2,240,568 | 5/1941 | Meacham et al. | 405/63 |
| 4,569,303 | 2/1986 | McDuff et al. | 114/227 |
| 5,009,179 | 4/1991 | Johnson | 114/229 |
| 5,009,180 | 4/1991 | Holt | 114/229 |
| 5,049,287 | 9/1991 | Pinder | 210/776 |

*Primary Examiner*—Jesus D. Sotelo

*Attorney, Agent, or Firm*—Zarley, McKee, Thomte, Voorhees, & Sease

[57] ABSTRACT

An oil control sock has an enlarged inlet end which is placed over the ruptured opening in the side of an oil vessel while the outer free open end is then raised to a position above the oil level in the tanker thereby allowing the oil to seek its own level. The oil sock can also be used with extensions as needed and may be used for unloading the tanker into an assisting vessel. The sock is held in place on the side of the vessel by electromagnets.

8 Claims, 3 Drawing Sheets

OIL SPILL CONTROL FOR AN OIL TANKER AND METHOD OF USING SAME

BACKGROUND OF THE INVENTION

Oil spills due to ruptures in the side of a tanker are becoming more of a problem particularly to the environment. Over the years there have been numerous proposals made as to how temporary repairs may be made to the rupture in the side of the tanker. In 1899 U.S. Pat. No. 635,939 is disclosed a temporary patch held in place by electromagnets over the rupture in the sidewall. In 1991 U.S. Pat. No. 5,009,180 is disclosed an inflatable bladder to apply pressure to a seal over the rupture.

The pressure associated with a leak may be such that putting the repair apparatus in place and holding it there presents a difficult problem. It is believed that what is needed is a device for not necessarily repairing the hole in the side of the vessel but instead controlling the outflow of oil in such a manner that it is not allowed to escape into the ocean water.

SUMMARY OF THE INVENTION

The oil spill control device and method of using same of this invention involves placing an elongated sock over the opening in the sidewall of the vessel and holding it there by electromagnets. The outer free end of the sock is then lifted upwardly and has a sufficient length that it extends above the oil level in the tanker. Oil will remain in the sock but never escape therefrom as long as the outer end of the sock is positioned above the oil level in the tanker. This concept does not focus on resisting the oil flow but allows it to safely seek its own level.

Little resistance to placing the device in place will be encountered due to the fact that oil will flow through the sock until it is secured in place on the side of the vessel. Only then would the outer free open end of the sock be raised upwardly resulting in some pressure being exerted upon the inside chamber of the sock. Extensions can be placed on the sock to extend the upper free end as high as needed and may even extend to another vessel should the ruptured vessel sink to the bottom of the ocean. In this case the sock with its extensions would be used as a conduit for pumping oil from the disabled tanker to the tanker giving assistance.

DESCRIPTION OF PREFERRED EMBODIMENT

Figure 1:
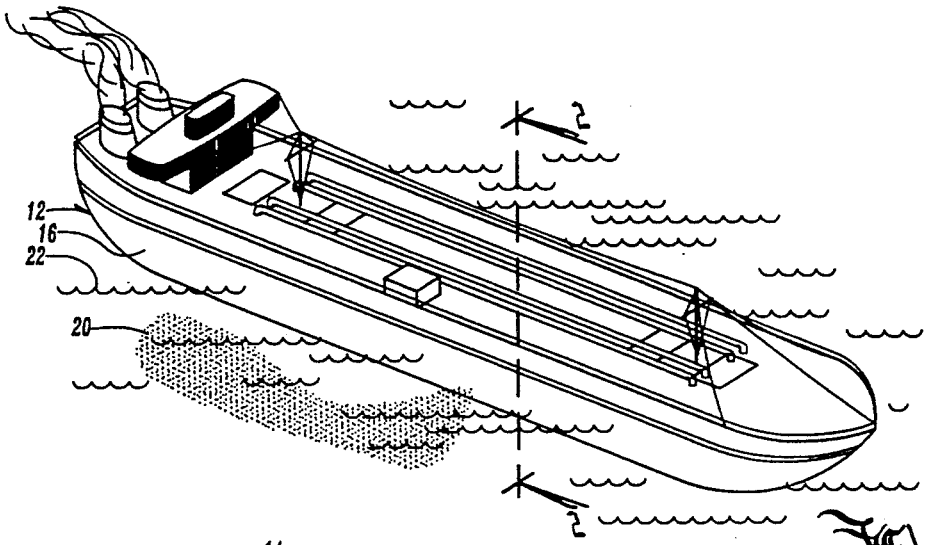
FIG. 1 is a perspective view of an oil tanker with a rupture in its side causing an oil spill.
Figure 2:
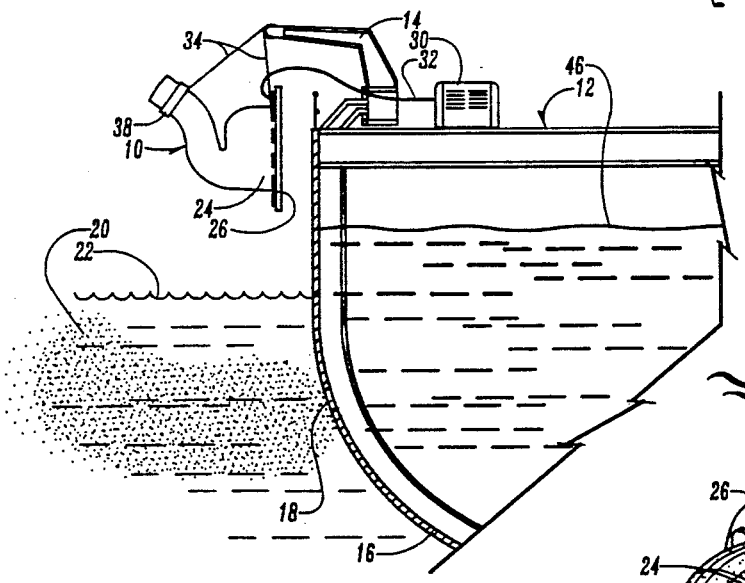
FIG. 2 is a cross-sectional view taken along line 2—2 in FIG. 1 showing the rupture and the sock supported by a crane ready to be placed in position over the side opening.
Figure 3:
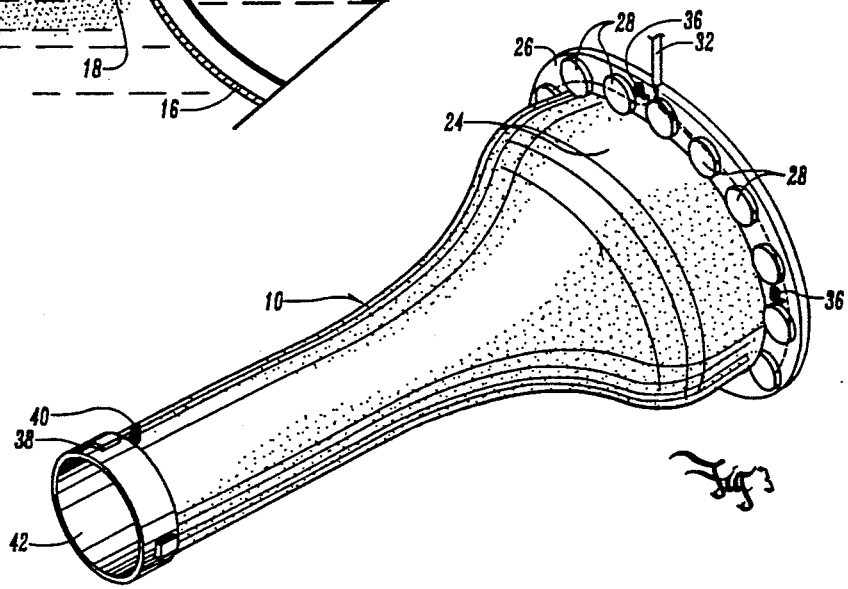
FIG. 3 is a perspective view of the sock.

The oil spill control sock of this invention is referred to generally in FIG. 3 by the reference numeral 10 and is shown in FIG. 2 supported on the side of a tanker 12 by a crane 14. The tanker 12 has a rupture in its sidewall 16 which involves an opening 18 from which oil 20 flows into the ocean water 22.

The sock 10 is elongated with an enlarged end 24 which is adapted to fit over the opening 18 in the sidewall 16. A flange 26 extends around the periphery of the end 24 and includes electromagnets 28 connected to a generator 30 through wiring 32.

Winch cables 34 are connected to hooks 36 on the flange 26.

Figure 6:
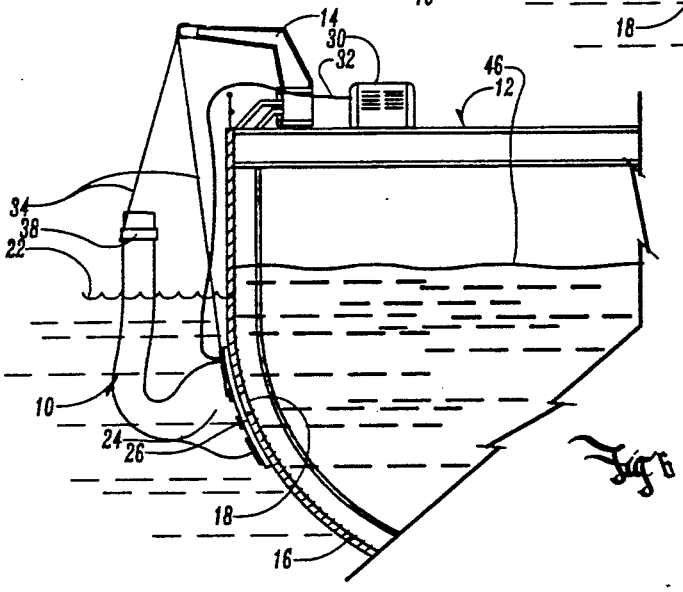
FIG. 6 is a view similar to FIGS. 2, 4 and 5 but showing the outer free end of the sock raised to a position above the oil level in the tanker thereby stopping flow of the oil.
Figure 9:
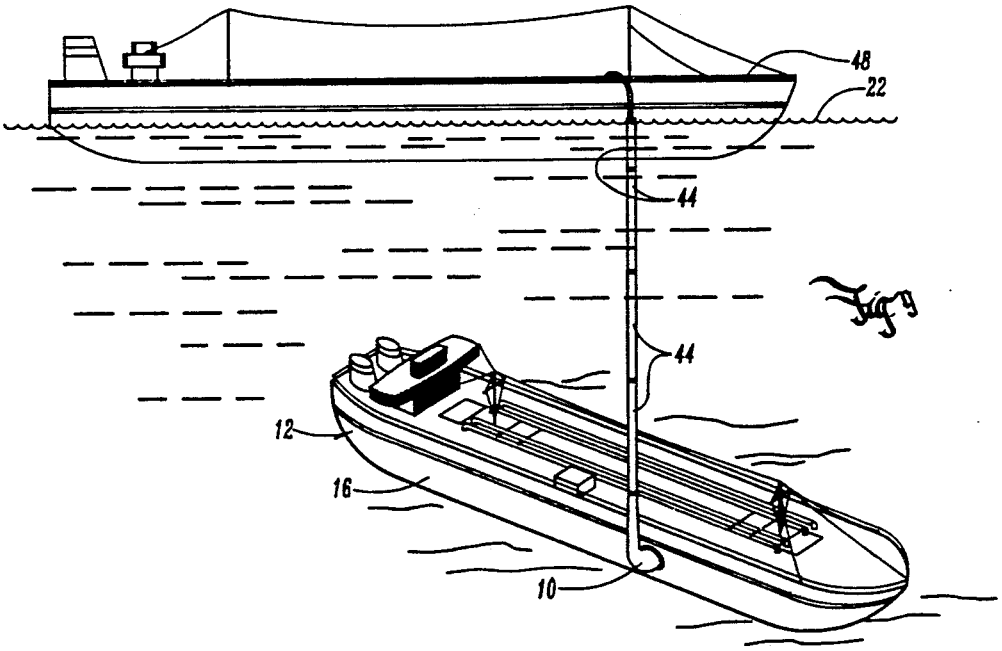
FIG. 9 is a perspective view of a tanker on the bottom of the ocean being emptied into an assisting tanker through use of the sock with extensions as a conduit for the transmission of oil.

The outer free end 38 is open and includes support hooks 40 and a flange 42 adapted to be connected to an extension section 44 as seen in FIG. 6 and 9.

Figure 4:
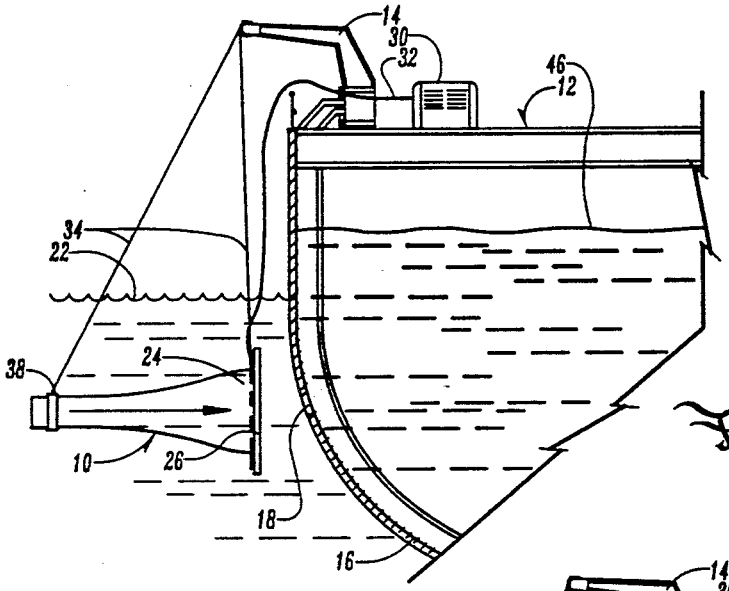
FIG. 4 is a view similar to FIG. 2 but showing the sock lowered to a position adjacent the opening in the side of the tanker.
Figure 5:
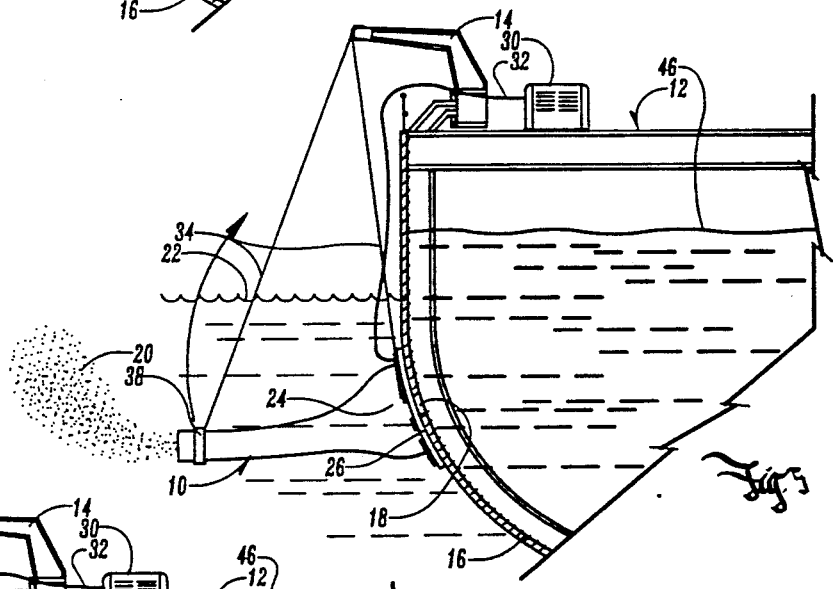
FIG. 5 is a view similar to FIGS. 2 and 4 showing the sock on the side of the tanker over the opening with the oil flowing through the sock into the water.

In operation, the oil spill control sock 10 is held over the side of the tanker by the crane 14 as seen in FIG. 2 and then lowered to a position adjacent the rupture opening 18 as seen in FIG. 4. The enlarged end 24 is then moved over the opening 18 and the sock 10 is held in place by activation of the electromagnets 28. At this point the oil 20 flows through the sock 10 out through the open end 38 and the sock offers no resistance to the oil pressure from the oil 20 in the tanker. Next, the outer free end 38 is raised to the position shown in FIG. 6 where the open end 38 is above the oil level 46 in the tanker thereby equalizing liquid pressures and controlling the outflow of oil from the tanker.

Figure 7:
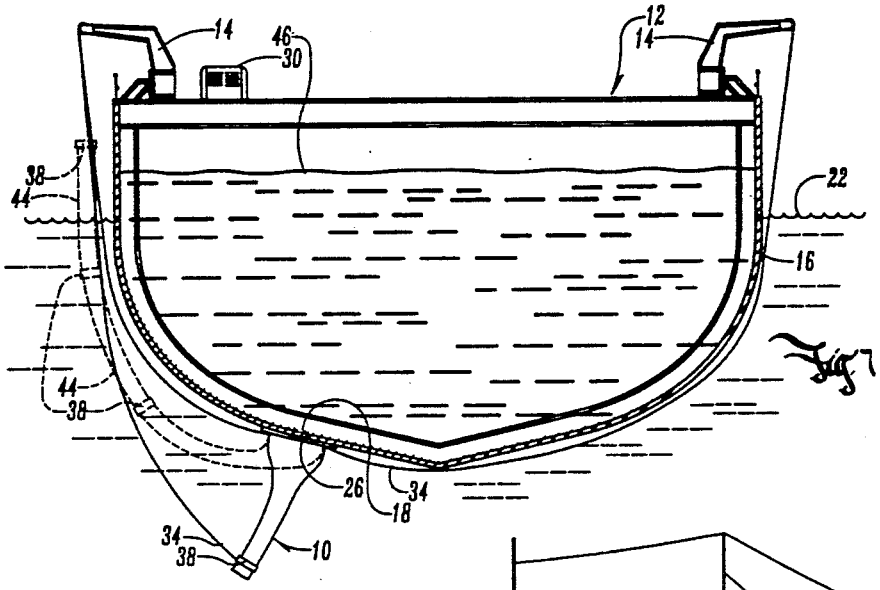
FIG. 7 is a view similar to FIGS. 5 and 6 but showing the sock on an opening located on the bottom of the tanker and with extensions being utilized to extend the sock to an elevation above the oil level in the tanker.

In FIG. 7 the sock 10 is shown lower on the sidewall of the tanker 12 thus requiring several extension sections 44 for the outer free end to extend above the oil level 46.

Figure 8:
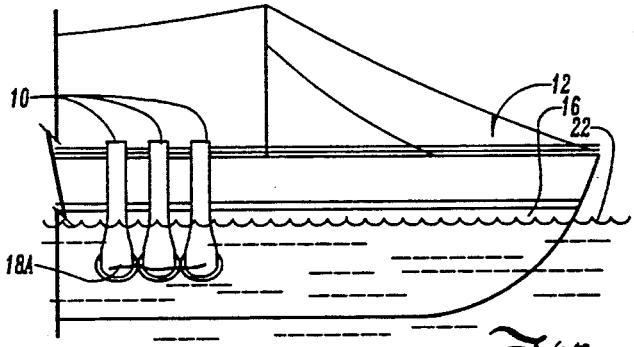
FIG. 8 is a fragmentary side elevation view of the tanker showing an elongated opening requiring the use of three socks.

In FIG. 8 the rupture 18A is elongated requiring the use of three socks 10 to cover the entire opening 18A.

In the event that the oil tanker 12 sinks to the bottom of the ocean as shown in FIG. 9 the sock 10 may be utilized with appropriate extension sections 44 to unload the tanker into an assisting vessel 48 through operation of a pump not shown on the assisting vessel 48.

It is thus seen that a simple but effective means has been provided for controlling the escaping oil through a ruptured opening in an oil vessel. The task of attaching the control device to the side of the vessel has been greatly simplified by the fact that the oil pressure is not resisted when applying the control device to the side of the vessel. Taking advantage of the oil seeking its own level by raising the outer free end of the sock 10 to a level above the oil level in the tanker produces a minimum of stress on the system. The oil control sock may be utilized in a number of different situations as may be presented from time to time.

What is claimed is:

1. An oil spill control system for an oil tanker said control system comprising, an elongated sock having at least one open end, said one open end being placed on and over a rupture opening on the side of the hull of a tanker, crane means for supporting and positioning said sock in position over an opening on the side of the hull of a tanker, and said crane means being connected to the other end of said sock to elevate it above the oil level in said tanker to thereby control outflow of oil from a tanker.

2. The structure of claim 1 wherein said one end of said sock includes electromagnets to secure said one end to the side of said hull of a tanker.

3. The structure of claim 1 wherein said sock is larger in area at said one end relative to the area of said sock at said other end.

4. The structure of claim 1 wherein said other end of said sock is open.

5. The method of controlling oil flow from a rupture opening on the side of the hull of an oil tanker, said method comprising the steps of, pg,8 providing an elongated sock having at least one open end, positioning said open end of said sock on and over the opening in the side of the hull, and elevating the other end of said sock above the oil level in said tanker thereby controlling the flow of oil from said tanker.

6. The method of claim 5 including the step of providing a sock having sufficient length to extend from said opening on the side of the hull to an elevation above the level of oil in the tanker.

7. The method of claim 5 including the step of providing pump means connected to the other end of said sock for removing oil from said tanker.

8. The method of claim 5 and the step of providing an open other end of said sock and allowing oil to flow through the sock and out the open other end while the one end of the sock is being attached to the side of the hull thereby minimizing the pressure on the sock while it is being put in place.

* * * * *